US007377560B2

(12) United States Patent
Wiemer et al.

(10) Patent No.: US 7,377,560 B2
(45) Date of Patent: May 27, 2008

(54) MAGNETIC SAFETY CLOSURE FOR A MOVABLE PROTECTION DEVICE

(75) Inventors: Uwe Wiemer, Neuss (DE); Yasar Cevik, Hagen (DE); Guntram Fust, Hattingen (DE); Joachim Haupt, Eschborn (DE)

(73) Assignee: K.A. Schmersal Holding KG, Wuppertal (DE)

( * ) Notice: Subject to any disclaimer, the term of this patent is extended or adjusted under 35 U.S.C. 154(b) by 0 days.

(21) Appl. No.: 11/555,627

(22) Filed: Nov. 1, 2006

(65) Prior Publication Data

US 2007/0096856 A1 May 3, 2007

Related U.S. Application Data

(62) Division of application No. 10/964,202, filed on Oct. 12, 2004, now abandoned.

(30) Foreign Application Priority Data

Oct. 18, 2003 (DE) ..... 103 48 527

(51) Int. Cl.
*E05C 17/56* (2006.01)
*E05B 3/00* (2006.01)

(52) U.S. Cl. ..... 292/251.5; 292/336.3; 292/DIG. 71

(58) Field of Classification Search ..... 292/251.5
See application file for complete search history.

(56) References Cited

U.S. PATENT DOCUMENTS

| | | | | |
|---|---|---|---|---|
| 2,673,111 A | | 3/1954 | Teetor | |
| 3,201,960 A | | 8/1965 | Berkowitz | |
| 4,904,005 A | * | 2/1990 | Frolov | 292/251.5 |
| 6,409,083 B1 | | 6/2002 | Link | |
| 6,758,504 B2 | * | 7/2004 | Mandall | 292/251.5 |

FOREIGN PATENT DOCUMENTS

| | | |
|---|---|---|
| DE | 9100626 U1 | 5/1991 |
| DE | 10150463 A1 | 4/2003 |
| EP | 926509 B1 | 6/1999 |
| WO | WO 02-100235 A1 | 12/2002 |

* cited by examiner

*Primary Examiner*—Patricia Engle
*Assistant Examiner*—Kristina R Fulton
(74) *Attorney, Agent, or Firm*—Townsend and Townsend and Crew LLP

(57) ABSTRACT

A magnetic safety closure for a protection device that is movable with respect to a fixed part includes a housing that is attachable to the protection device and includes a handle for opening and closing the protection device. The housing includes a sensor housing that is attachable to the fixed part and provided with a sensor for determining whether the protection device is closed or open. The housing attachable to the protection device has an initiating device for the sensor and is opposite the sensor when the protection device is closed. The housing and the sensor housing share a magnet arrangement having at least one holding magnet and an associated pole plate. The handle is a two armed lever pivotably mounted on the housing, with arm of the lever facing the sensor housing with its free end disconnecting the holding magnet from its associated pole plate when the handle is pivoted out in order to open the protection device.

9 Claims, 5 Drawing Sheets

MAGNETIC SAFETY CLOSURE FOR A MOVABLE PROTECTION DEVICE

FIELD OF THE INVENTION

The invention relates to a magnetic safety closure for a movable protection device which can be moved with respect to a fixed part, for instance a door or flap of an enclosure of a prohibited area wherein a machinery as a robot or the like is arranged, said machinery when operating being able to cause a danger for working people in the environment of the machinery.

In the case of access protection devices for a physical area, which can be accessed and closed, of a machinery or machine installation (understood here to mean, for example, machines or components for production, treatment or processing purposes as well as installations comprising said machines and components and possibly also chemical installations or the like), protection devices in the form of doors or flaps, whose closed position is detected by means of at least one sensor, are provided for the purpose of accessibility. When protection devices such as doors or flaps made of plastic, in particular made of transparent plastic for visibility reasons, are used, they can be easily warped. Accordingly, there is also a risk of such protection devices becoming loose and the associated sensors, in some circumstances, not responding or responding too early.

DESCRIPTION OF THE RELATED ART

German Utility Model DE 91 00 626 U1 describes an electrically releasable unlocking apparatus in which a lever biased against a spring is held locked by a permanent magnet. The force of the permanent magnet can be cancelled out by an electrically activatable coil such that the biase of the spring comes into effect. The spring causes a cylinder to extend and causes the lever to move with it in the same direction about its point of rotation.

SUMMARY OF THE INVENTION

An object of the invention is to provide a magnetic safety closure for a movable protection device, in which the operability of the safety closure is not adversely affected by warping of the protection device.

According to magnetic safety closure for the protection device of the invention, a sensor which is responsible for detecting the closed and opened state of the protection device, in particular a safety sensor, is positioned in the immediate vicinity of a locking device for the protection device, that is to say is integrated in the locking device. As a result, distortion in the protection devices is not disadvantageously evident.

Further objects, advantages and embodiments of the invention can be found in the description below.

BRIEF DESCRIPTIONS OF THE DRAWINGS

The invention will now be explained in greater detail in the following with reference to exemplary embodiments illustrated in the attached drawings.

DESCRIPTION OF PREFERRED EMBODIMENTS

Figure 1:
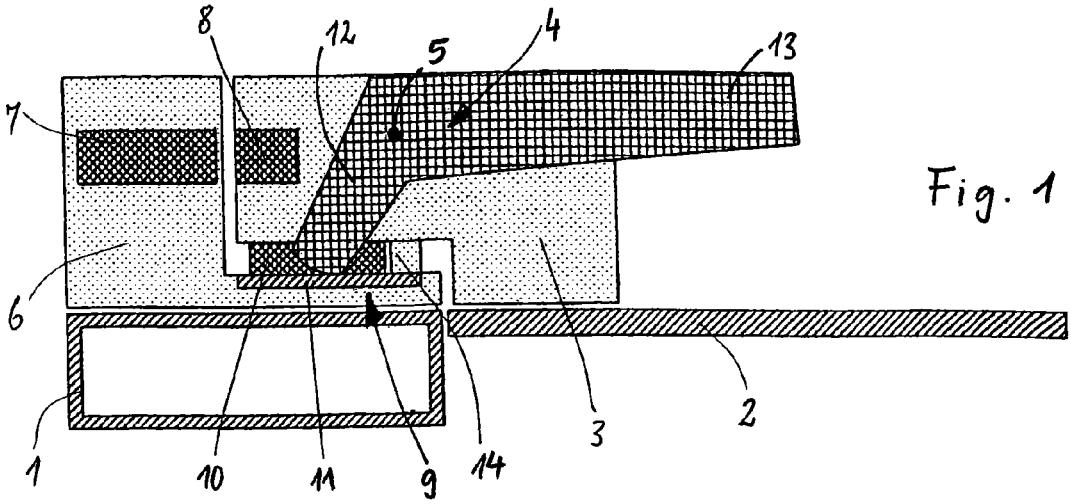
FIG. 1 shows a schematic section through a first embodiment of a magnetic safety closure in the closed state.

In the embodiment illustrated in FIG. 1, a frame 1, illustrated here by way of example as a box-like profile, of a fixed part in the form of fencing, a housing or the like is provided, which frame accommodates a pivotable protection device 2 in the form of a door or flap which is coupled, for example by means of hinges, to the side of the frame 1 which is not illustrated.

A housing 3 which is fitted with a handle 4 for opening and closing the protection device 2, which handle can be pivoted with respect to the housing 3 about an axis 5, is attached to the protection device 2.

Also, a sensor housing 6 which accommodates a sensor 7, which is used to determine whether the protection device 2 is closed or open, is attached to the frame 1. The sensor 7 is correspondingly operated by means of an initiating device 8 which is accommodated by the housing 3 attached to the protection device 2. The initiating device 8 is opposite the sensor 7 when the protection device 2 is closed.

The sensor 7 may be an electronic sensor which interacts with a TAG as the initiating device 8, however it may also comprise one or more reed switches which can be initiated by magnets as the initiating device 8. Alternatively, the sensor may comprise corresponding contactless proximity switches, light barriers or the like, or else electromechanical sensors. Therefore, safety sensors as described in German Patent DE 100 43 237 C1 or German Patent Application DE 103 07 044 A1 (which are hereby incorporated by reference) may be used, for example.

Figure 2:
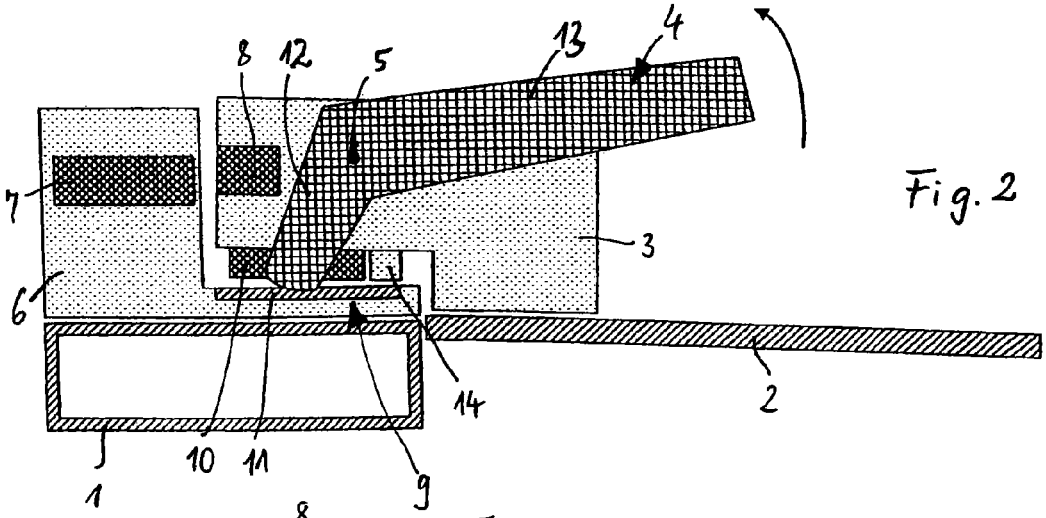
FIGS. 2 and 3 show the operation of the safety closure from FIG. 1.
Figure 3:
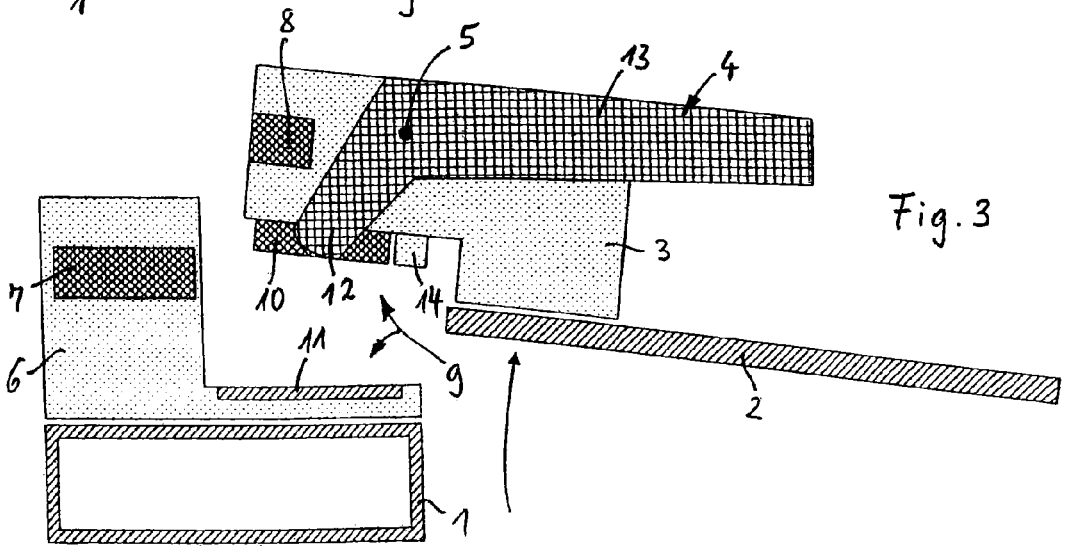

The housing 3 also has a magnet arrangement 9 having at least one holding magnet 10, and the sensor housing 6 is correspondingly provided with opposite pole plates 11 for the holding magnets 10. When the protection device is closed, the holding magnet 10 and the associated pole plate 11 are opposite each another such that the intended holding force for locking the protection device 2 is supplied. The holding magnet 10 and pole plate 11 can of course also interchangeably be accommodated in the sensor housing 6 and housing 3 respectively. A magnet could also be used in place of a pole plate 11. The handle 4 is a two-armed lever mounted on the housing 3, one arm 12 of the lever facing the sensor housing 6 and with its free end disconnecting the holding magnets 10 of the magnet arrangement 9 from the associated pole plates 11 when said handle is pivoted out in order to open the protection device 2. For this purpose, the handle 4 can be grasped by its other arm 13 and pivoted outwards with respect to the protection device 2, cf. FIG. 2, as a result of which the free end of the arm 12 engages with the sensor housing 6 adjacent to the pole plate 11 or else engages with the pole plate itself and, when it is pivoted further, lifts the holding magnet 10 off its pole plate 11 against the holding force acting between these two components, such that the protection device is opened, cf. FIG. 3.

The force required for opening can be chosen to be significantly less than the locking force of the magnet device 9 by appropriate choice of the ratio of the lengths of the arms 12, 13 of the handle, which is in the form of a two-armed lever.

A stop 14 is expediently arranged adjacent to the magnet arrangement 9, the at least one pole plate 11 at the same time being movable in the direction of the magnet arrangement 9 corresponding to predetermined play. The latter leads to secure contact between the holding magnet 10 and pole plate 11 when the protection device 2 is closed, while the stop 14 prevents the closing energy and the effect of any accompanying impact being transferred to the magnet device 9 when the protection device is closed. The pole plates 11 which are movable in this way also allow the protection device 2 to be seated with a certain inclination.

It is also expedient to provide corresponding play in order to compensate for incorrect alignment of the protection device 2. This can be done—as illustrated by way of example in FIG. 4—by arranging a ferromagnetic plate 10*a*, which has larger dimensions than the holding magnet 10, on both sides of each holding magnet 10 with play with respect to the axis 5 passing through, the plates 10*a* being held on the respective holding magnet 10 as a result of the magnetic force and being moved corresponding to any misalignment when contact is made with the respective pole plate 11. However, the pole plates 11 can also be held by the sensor housing 6 with lateral play. In order to be able to compensate for a limited change in position of the protection device 2, the pole plates 11 can also be larger than the associated holding magnets 10.

In the embodiment illustrated in FIG. 1, the housing 3 and the sensor housing 6 are each angled such that they correspondingly overlap, for example, a rotary door or flap in the region of the magnet arrangement 9 when the protection device 2 is closed.

Figure 4:
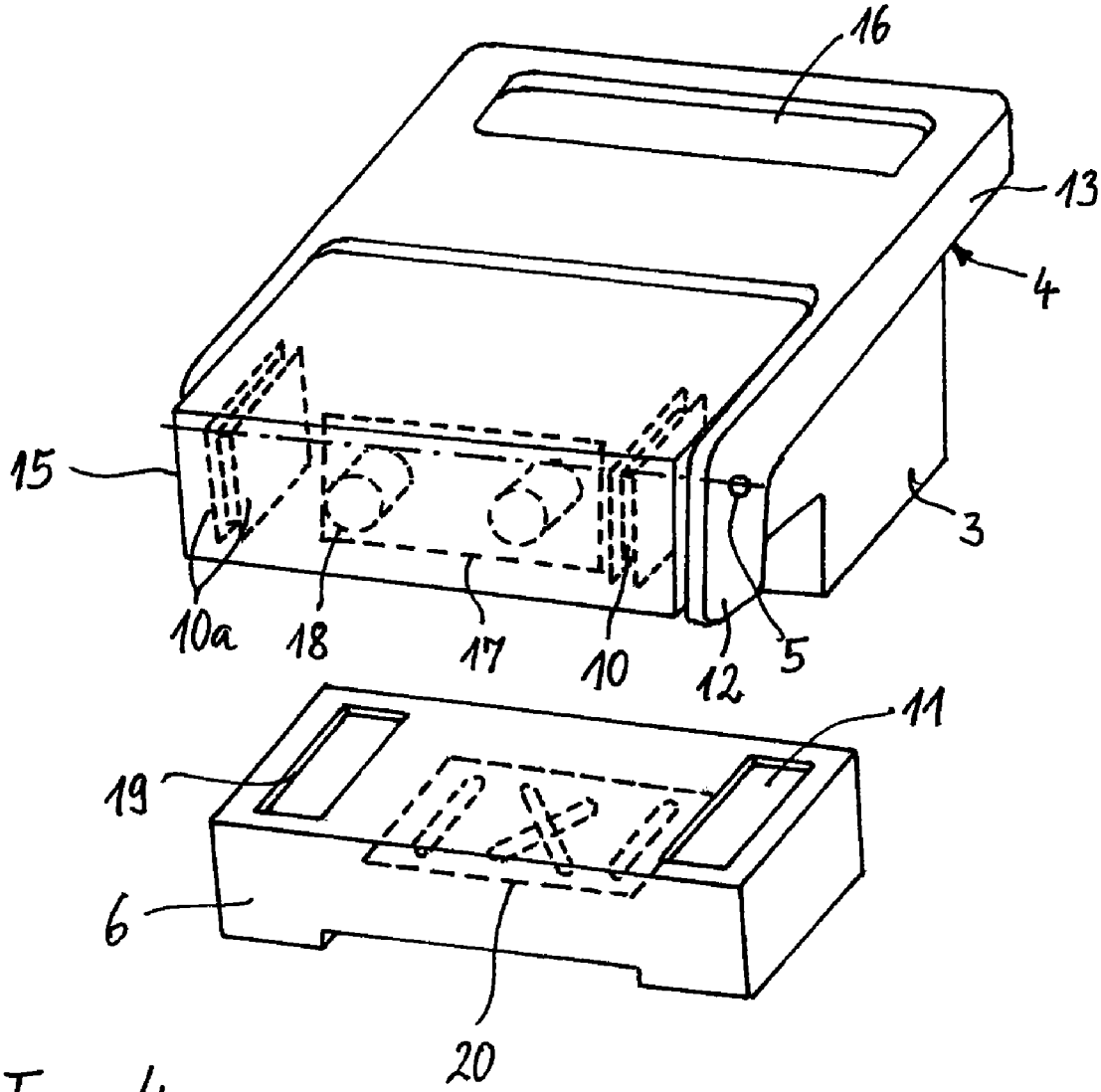
FIG. 4 shows a less schematic, perspective view of one embodiment of the safety closure from FIG. 1.

According to FIG. 4, the handle 4 is mounted with its axis 5 in its projection 15 which overlaps the sensor housing 6. In this case, the handle 4 surrounds the housing 3 in the manner of a fork (or vice versa) and is provided with an engagement recess 16 at the end of its arm 13. A holding magnet 10, which projects out of the projection 15 on the side facing the pole plates 11, is located in the projection 15 on each of the two sides, and, adjacent to the end face of the projection 15, the initiating device 8 is in the form of a mount 17 with two tripping magnets 18 for reed switches for the sensor 7 in the sensor housing 6 (the sensor 7 is not illustrated in FIG. 4). The sensor housing 6 accommodates the pole plates 11 with lateral and vertical play beneath housing openings 19. The sensor housing 6 also accommodates a printed circuit board 20.

Figure 5:
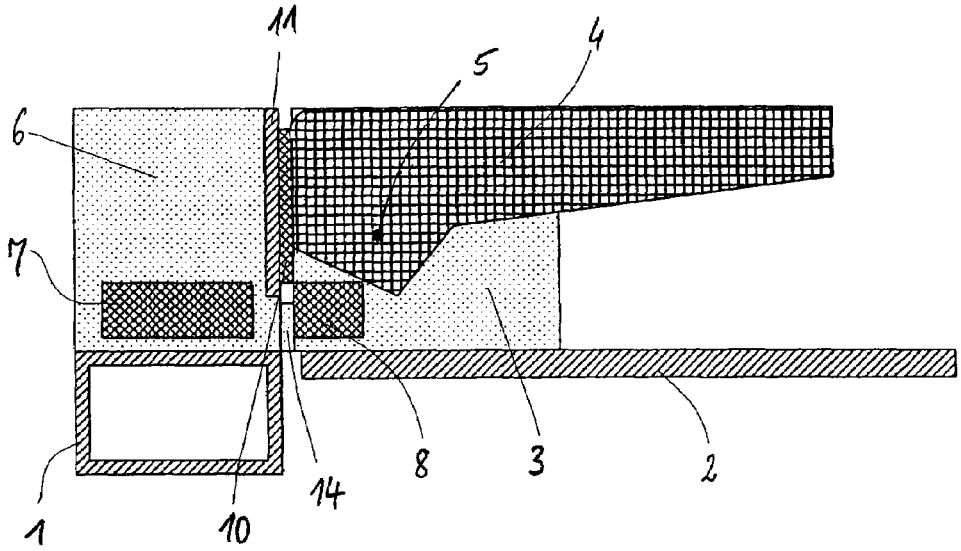
FIG. 5 shows a schematic section through a second embodiment of a magnetic safety closure in the closed state.
Figure 6:
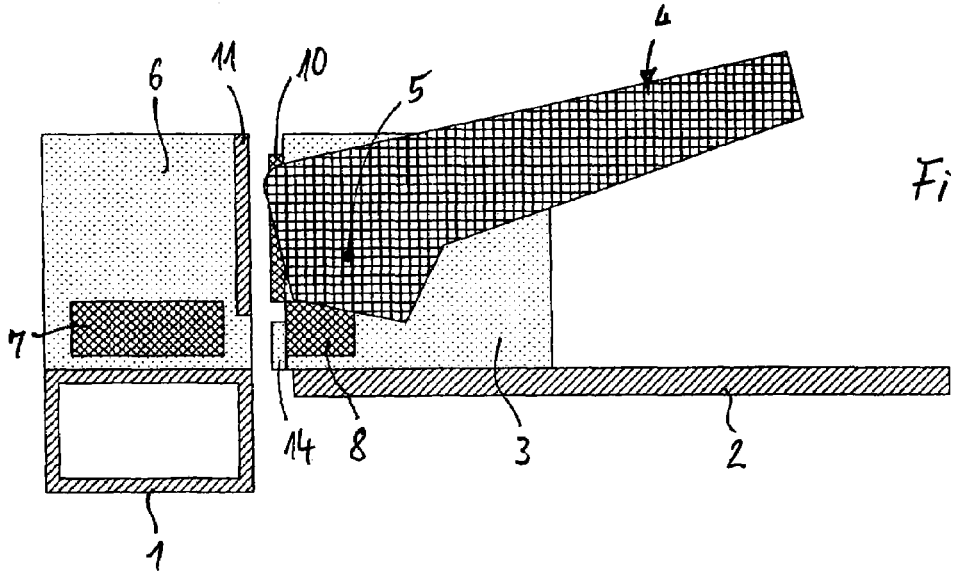
FIG. 6 shows the operation of the safety closure from FIG. 5.

The embodiment illustrated in FIG. 5 is a protection device 2 in the form of a sliding door or sliding flap. In this case, the housing 3 and the sensor housing 6 are cuboid, the magnet arrangement 9 being attached in such a way that the magnetic force exerted acts perpendicular to the direction of movement of the protection device 2. The holding magnet 10 is disconnected from its pole plate 11 by lifting the handle 4 away from the protection device 2 (FIG. 6), and the protection device can be pushed open.

In the case of a protection device 2 in the form of a sliding door, it may also be expedient if the lever can be pivoted in the direction of the door in order to open it. For this purpose, the shaft 5 in FIG. 5 only needs to be moved upwards in a corresponding manner.

Figure 7:
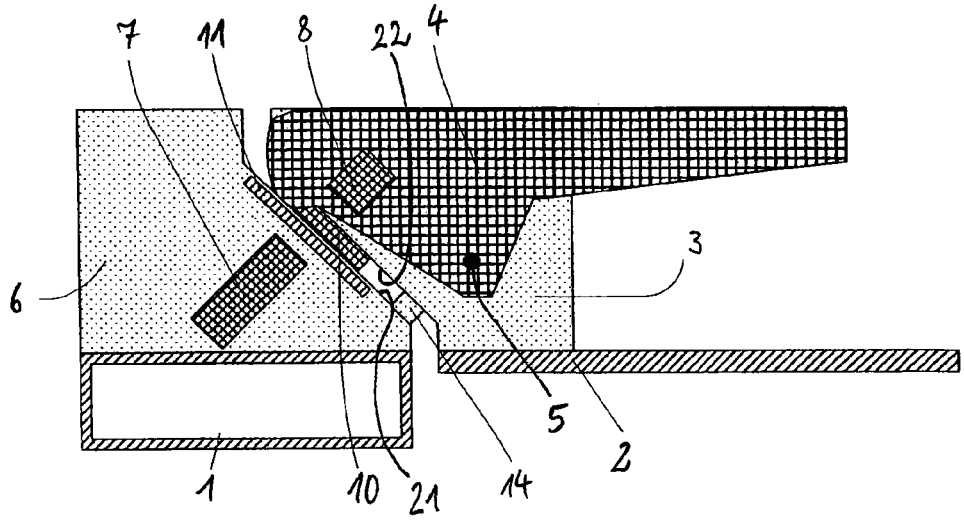
FIG. 7 shows a schematic section through a third embodiment of a magnetic safety closure in the closed state.
Figure 8:
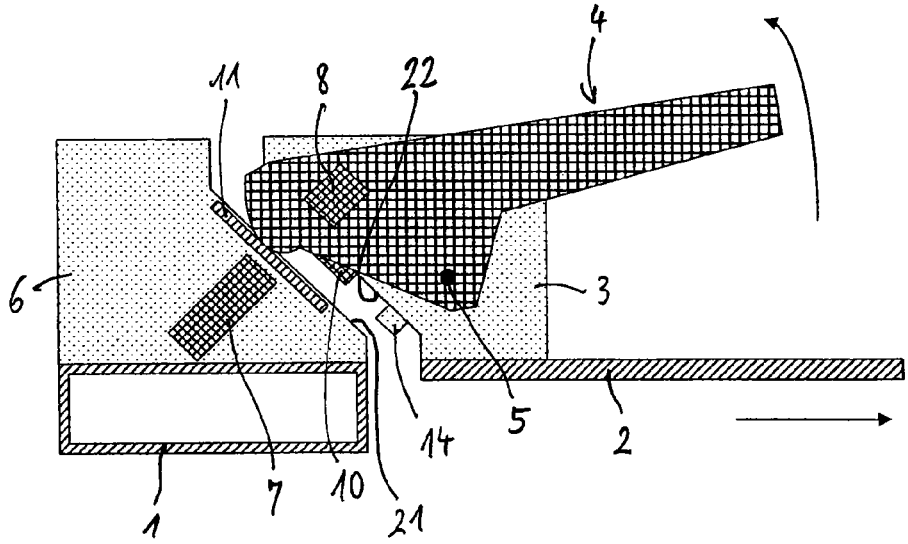
FIGS. 8 and 9 show the embodiment from FIG. 7 in the open state for a pivotable or a movable protection device.
Figure 9:
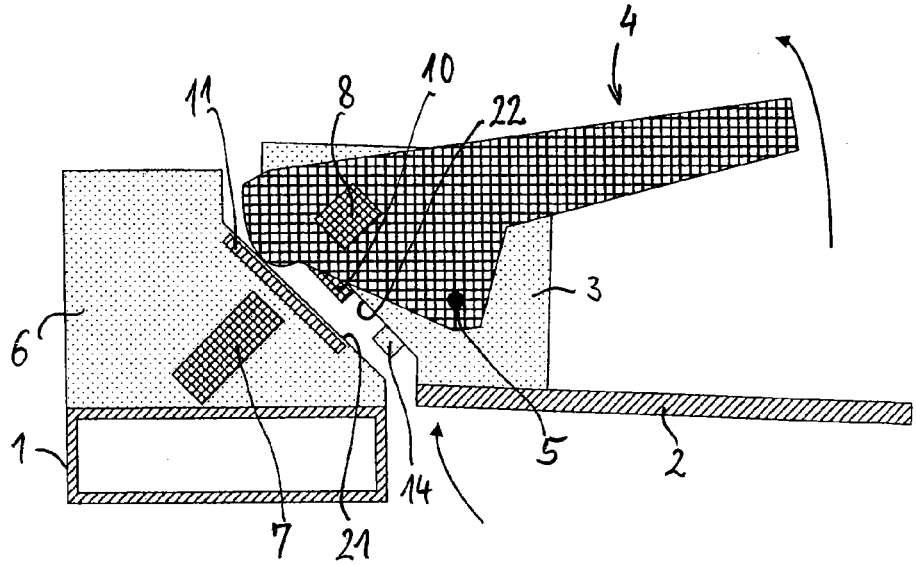

In the embodiment illustrated in FIG. 7, the housing 3 and the sensor housing 6 are provided with oblique surfaces 21, 22 which face one another such that the housing 3 partially overlaps the sensor housing 6 on the frame 1, there being, between the oblique surfaces 21, 22, a gap which can be bridged by the magnet device 9 since the at least one holding magnet 10 and the associated pole plate 11 are arranged adjacent to the respective oblique surfaces 21, 22. The sensor 7 and the initiating device 8 are also adjacent to the oblique surfaces 21, 22. The oblique surfaces 21, 22 are at an angle of approximately 30 to 60°, in particular approximately 45°, to the surface of the protection device 2 such that this device can be opened by pivoting out the handle 4—independently of whether the protection device 2 is pivotable or movable—against the magnetic locking force.

Figure 10:
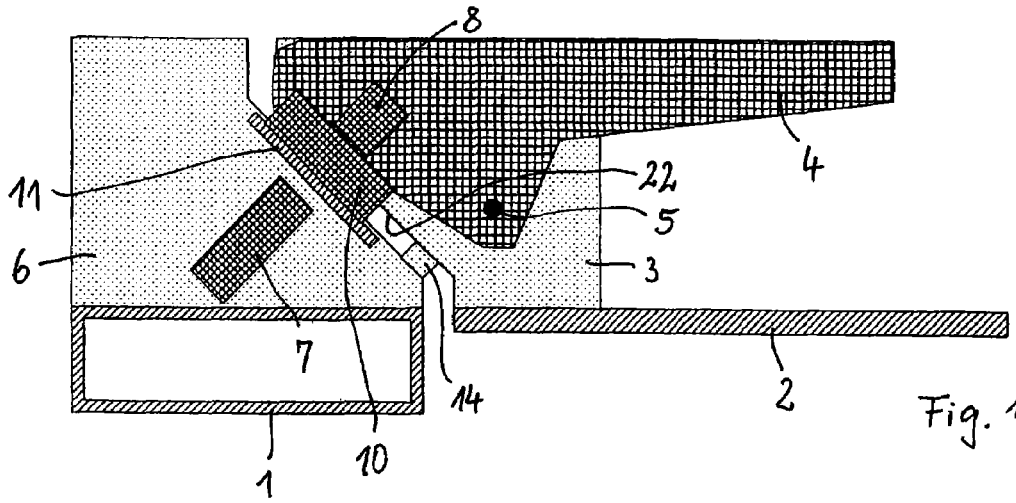
FIGS. 10 to 12 show schematic sections through an additional embodiment in the closed state, at the start of opening and in the open state.
Figure 11:
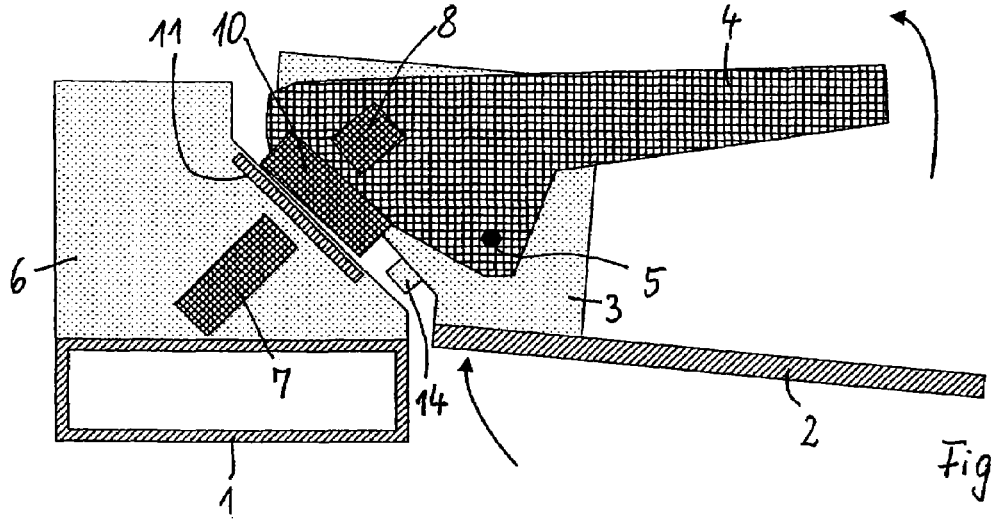
Figure 12:
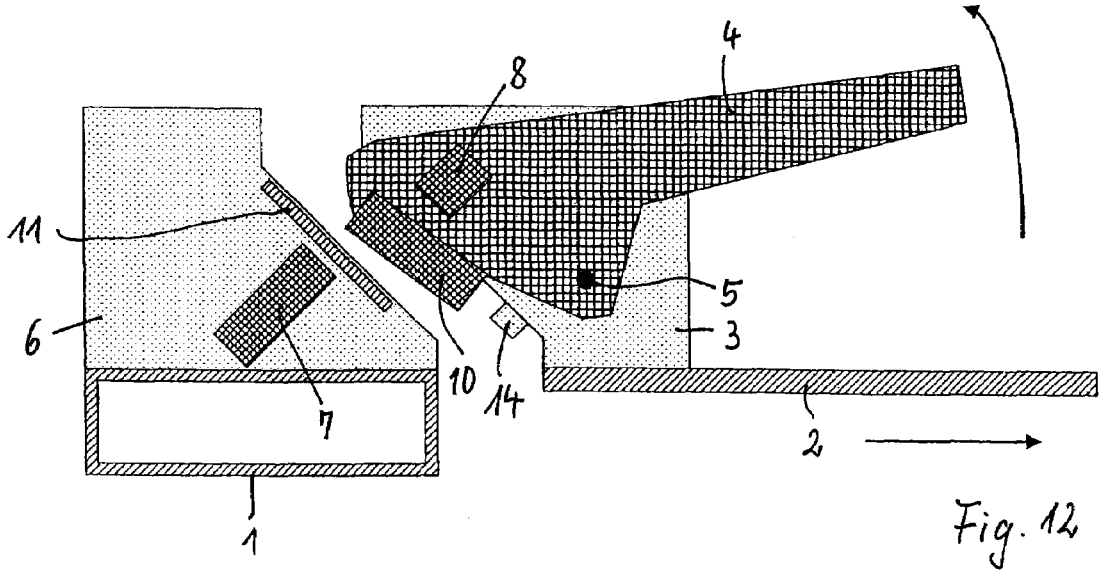

In the embodiment illustrated in FIG. 10, as compared to the embodiment from FIG. 7, the holding magnets 9 are not attached in or to the housing 3, but are attached to the lever itself. By pivoting the lever out, the holding magnets 9 are disconnected from their pole plates 10 to such an extent that the remaining magnetic force acting between these two components can be readily overcome by pivoting out a corresponding protection device 2, FIG. 10, or by moving a corresponding protection device 2, FIG. 11, in order to open the protection device.

While the invention has been shown and described with reference to preferred embodiments, it should be apparent to one of ordinary skill in the art that many changes and modifications may be made without departing from the spirit and scope of the invention as defined in the claims.

What is claimed is:

1. A magnetic safety closure for a protection device moveable with respect to a fixed part, comprising:

a housing attachable to the protection device and provided with a handle for opening and closing the protection device;

the housing further comprising a sensor housing attachable to the fixed part and provided with a sensor for determining whether the protection device is closed or open;

the housing attachable to the protection device having an initiating device for the sensor, which is opposite said sensor when the protection device is closed; and the housing and the sensor housing sharing between them a magnet arrangement having at least one holding magnet and an associated pole plate;

wherein the handle is a two-armed lever pivotably mounted on the housing, one arm of the lever facing the sensor housing and with its free end disconnecting the at least one holding magnet of the magnet arrangement from its associated pole plate when the handle is pivoted out in order to open the protection device; and wherein adjacent to the at least one holding magnet, a magnetized plate, which has larger dimensions than the holding magnet, is arranged with play with respect to the holding magnet.

2. The closure according to claim 1, wherein the at least one holding magnet is held with lateral play.

3. The closure according to claim 1, wherein the at least one holding magnet is held with play in the direction of the associated pole plate.

4. The closure according to claim 1, wherein the at least one holding magnet is arranged on the rotation axis of the lever.

5. The closure according to claim 1, wherein a stop is arranged adjacent to the magnet arrangement.

6. The closure according to claim 1, wherein the arm, which faces away from the sensor housing, of the lever can be pivoted away from the protection device or towards the latter in order to open the protection device.

7. The closure according to claim 1, wherein a gap which runs obliquely with respect to the plane of the protection device and can be bridged by the magnet arrangement is provided between the housing and the sensor housing such that the protection device, with the housing, overlaps the fixed part.

8. The closure according to claim 7, wherein the gap runs obliquely with respect to the plane of the protection device at an angle of 30° to 60° and in particular approximately 45°.

9. The closure according to claim 1, wherein the protection device is pivotable with respect to the fixed part.

* * * * *

UNITED STATES PATENT AND TRADEMARK OFFICE

CERTIFICATE OF CORRECTION

PATENT NO. : 7,377,560 B2
APPLICATION NO. : 11/555627
DATED : May 27, 2008
INVENTOR(S) : Uwe Wiemer et al.

It is certified that error appears in the above-identified patent and that said Letters Patent is hereby corrected as shown below:

In column 4, line 41, claim 1, insert the word --device-- after the word "which".

Signed and Sealed this

Twenty-ninth Day of July, 2008

JON W. DUDAS
*Director of the United States Patent and Trademark Office*